US010218155B2

(12) United States Patent
Pottiez et al.

(10) Patent No.: US 10,218,155 B2
(45) Date of Patent: Feb. 26, 2019

(54) CORONA IGNITION DEVICE HAVING A HOLLOW COIL BODY

(71) Applicant: BorgWarner Ludwigsburg GmbH, Ludwigsburg (DE)

(72) Inventors: Christian Pottiez, Eppingen (DE); Johannes Hasenkamp, Ditzingen (DE)

(73) Assignee: BORGWARNER LUDWIGSBURG GMBH, Ludwigsburg (DE)

( * ) Notice: Subject to any disclaimer, the term of this patent is extended or adjusted under 35 U.S.C. 154(b) by 330 days.

(21) Appl. No.: 15/228,516

(22) Filed: Aug. 4, 2016

(65) Prior Publication Data

US 2017/0040776 A1 Feb. 9, 2017

(30) Foreign Application Priority Data

Aug. 7, 2015 (DE) ..... 10 2015 113 075

(51) Int. Cl.

| | |
|---|---|
| ***F23Q 3/00*** | (2006.01) |
| ***H01T 19/00*** | (2006.01) |
| ***F02P 3/02*** | (2006.01) |
| ***H01T 13/44*** | (2006.01) |
| ***H01T 13/50*** | (2006.01) |

(52) U.S. Cl.

CPC ..... *H01T 19/00* (2013.01); *F02P 3/02* (2013.01); *H01T 13/44* (2013.01); *H01T 13/50* (2013.01)

(58) Field of Classification Search

None

See application file for complete search history.

(56) References Cited

U.S. PATENT DOCUMENTS

| | | | | |
|---|---|---|---|---|
| 4,767,967 | A * | 8/1988 | Tanaka | F02P 3/12 310/318 |
| 6,467,447 | B1 * | 10/2002 | Holmes | F02P 13/00 123/169 PA |
| 2012/0176724 | A1 | 7/2012 | Burrows et al. | |
| 2013/0155570 | A1 | 6/2013 | Stifel et al. | |
| 2014/0216382 | A1 | 8/2014 | Stifel et al. | |
| 2014/0328003 | A1 * | 11/2014 | Achtstatter | H01T 13/50 361/263 |

FOREIGN PATENT DOCUMENTS

| | | | |
|---|---|---|---|
| CN | 102619667 | A | 8/2012 |
| DE | 10 2013 101 060 | A1 | 8/2014 |
| EP | 2 065 907 | A1 | 6/2009 |

* cited by examiner

*Primary Examiner* — Stephen W Jackson

(74) *Attorney, Agent, or Firm* — Bose McKinney & Evans LLP

(57) ABSTRACT

This disclosure relates to a corona ignition device having a coil, which has an elongate coil body and a coil winding wound onto the coil body, an ignition electrode connected to the coil, and an insulator, inside which the ignition electrode is situated. According to the present disclosure, the coil body has a hollow section.

10 Claims, 3 Drawing Sheets

CORONA IGNITION DEVICE HAVING A HOLLOW COIL BODY

RELATED APPLICATIONS

This application claims priority to DE 10 2015 113 075.0, filed Aug. 7, 2015, which is hereby incorporated herein by reference in its entirety.

BACKGROUND

The invention refers to a corona ignition device such as the type generally known from DE 10 2013 101 060 A1, for example.

Corona ignition devices, which ignite fuel in an internal combustion engine by means of a corona discharge, are an alternative to conventional spark plugs, which ignite fuel by means of an arc discharge. Corona ignition devices make it possible to make the mixture more lean and can therefore improve the power and consumption of internal combustion engines.

SUMMARY

This disclosure teaches an improvement to the service life of corona ignition devices.

Corona ignition devices are subjected to considerable mechanical stresses, in particular vibrational stresses, in a vehicle. Vibrations of the coil body of a corona ignition device that are caused by engine operation can exert stress on connection points of the coil body and damage them over time. This problem can be counteracted by careful support of the coil body. However, impairment of the electrical quality should be avoided in the process.

According to this disclosure, the problem of high vibrational stressed is solved in that, instead of a solid coil body, a coil body is used that has a hollow, empty section, for example a section in the form of a tube or sleeve. The coil body of a corona ignition device according to this disclosure therefore has a lower mass than the coil body of conventional corona ignition devices and therefore higher resonant frequencies, which are excited by the vehicle engine only to a correspondingly smaller extent. Consequently, the mechanical stress on the coil body of a corona ignition device according to this disclosure is advantageously low, and therefore premature failure owing to damage of the connection points of the coil body is avoided.

The coil body of a corona ignition device according to this disclosure can be hollow over the entire length of said coil body or can also have a solid section next to a hollow section. If the coil body has a solid section, said section can be provided with one or more grooves, which extend in the longitudinal direction and are empty. The mass of the solid section can be reduced by means of such grooves.

An advantageous refinement of this disclosure provides for the coil body to be thinner at its end facing the ignition electrode than at its end facing away from the ignition electrode, so that the coil winding has a smaller diameter at its end facing the ignition electrode than at its end facing away from the ignition electrode. For example, a thinner section of the coil body can bear one part of the coil winding, which is arranged in a spark plug shaft of the engine, and a thicker section of the coil body can bear a further part of the coil winding outside the spark plug shaft. Such a coil body makes it possible to improve the electrical properties, for example by means of a ferrite core. Better utilization of the installation space is also achieved.

If the coil body has a thicker and a thinner section, at least the thicker section is preferably hollow. The thinner section can likewise be hollow but does not have to be, since the possible weight saving from a hollow configuration of the thinner section is relatively low. The thicker section preferably tapers towards the thinner section and thus towards the ignition electrode, for example by the thicker section being conical or bounding the thinner section with a conical subsection. The thicker section can also have a cylindrical subsection next to a subsection that bounds the thinner section and tapers towards said thinner section. In such a case, both the tapering section and the cylindrical section are surrounded by turns of the winding.

A further advantageous refinement of this disclosure provides for the hollow section of the coil body to bear at least a quarter of the total number of turns of the coil winding. For example, the hollow section of the coil body can be surrounded by a third or more of the turns of the coil winding.

The coil body can be manufactured in one piece. Particularly if the coil body has a thicker section and a thinner section, it is simpler to assemble the coil body from two part-bodies. The two part-bodies can each form a longitudinal part of the coil body or each be in the form of a sleeve, tube or pin. The part-bodies can be connected in a form-fitting manner, for example locked or with a bayonet closure. Another possibility is to connect the part-bodies in a materially cohesive manner, for example by welding.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
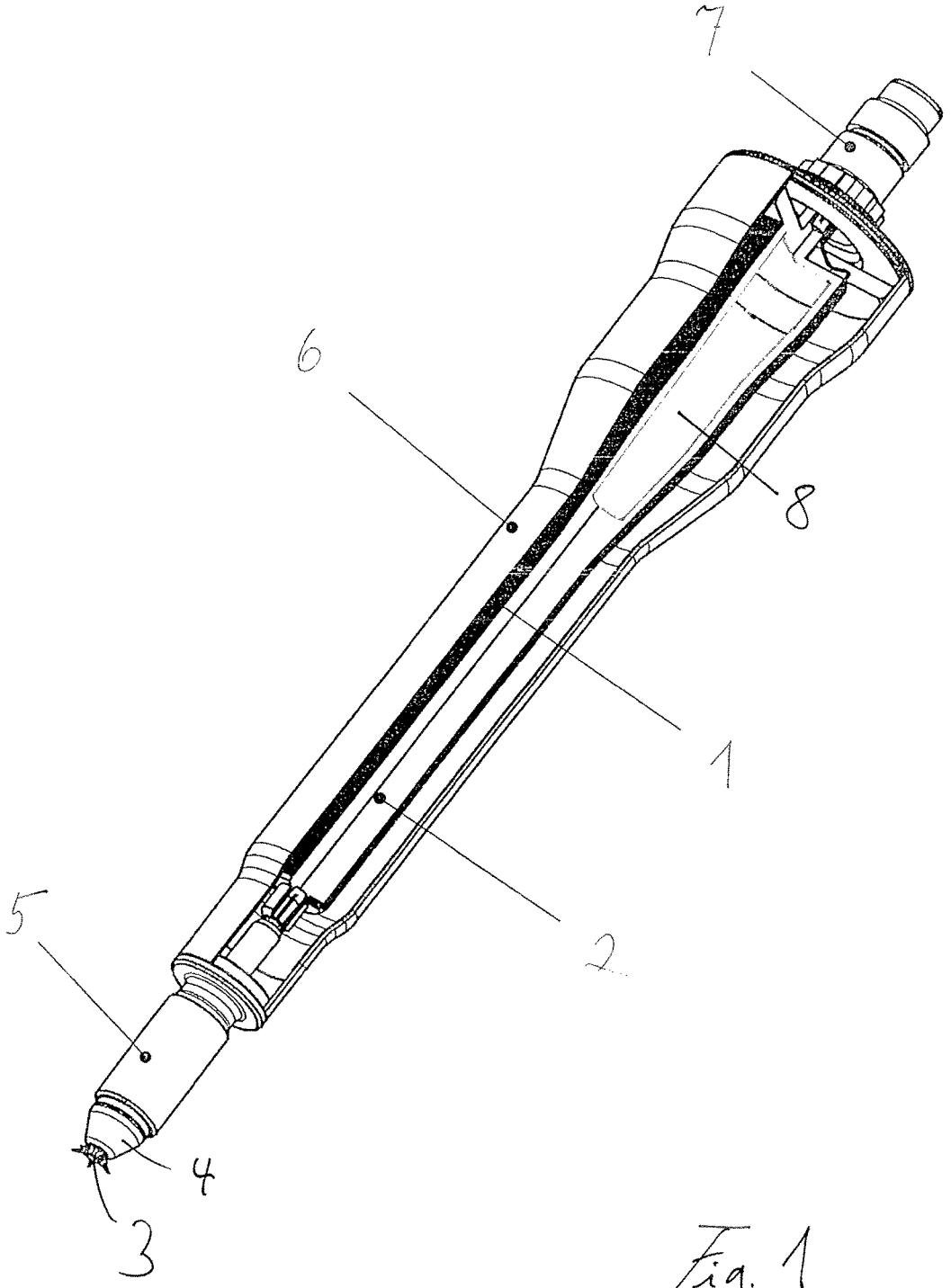
FIG. 1 shows a partially cut-away view of a corona ignition device.

The corona ignition device shown schematically in FIG. 1 has a coil having a preferably single-layered coil winding 1 and a coil body 2, which is series-connected to an ignition electrode 3, which can have a plurality of ignition tips. The ignition electrode 3 is situated inside an insulator 4, which is held in a housing 5 and can project out of said housing. In the embodiment shown, a rear part 6 of the housing 5 surrounds the coil, while a front part of the housing 5 surrounds a section of the insulator 4. The corona ignition device has at its rear end an electrical connection in the form of a plug 7. The housing 5 is filled with an electrically insulating gas, which may be under pressure, e.g., of 300 kPa or more.

The coil body 2 is thinner at its end facing the ignition electrode 3 than at its end facing away from the ignition electrode 3, so that the coil winding 1 has a smaller diameter at its end facing the ignition electrode 4 than at its end facing away from the ignition electrode 4.

The elongate coil body 2 on which the coil winding 1 is wound has a hollow section that contains dry air or any other electrically insulating gas, e.g., nitrogen. The empty cavity 8 of said section is indicated in FIG. 1. The hollow section is surrounded at least by a part of the coil winding. The fact that at least part of the coil body 2 is hollow means that the weight of said coil body can be reduced to the extent that the resonant frequencies of the coil body 2 lie outside the excitation range of internal combustion engines customary in vehicles and/or that the occurring radial deflections of the coil body 2 are low. Vibrations of the coil body 2, which exert considerable stress on connection points of the coil, can thus be avoided and the service life of the corona ignition device can be prolonged.

Figure 2:
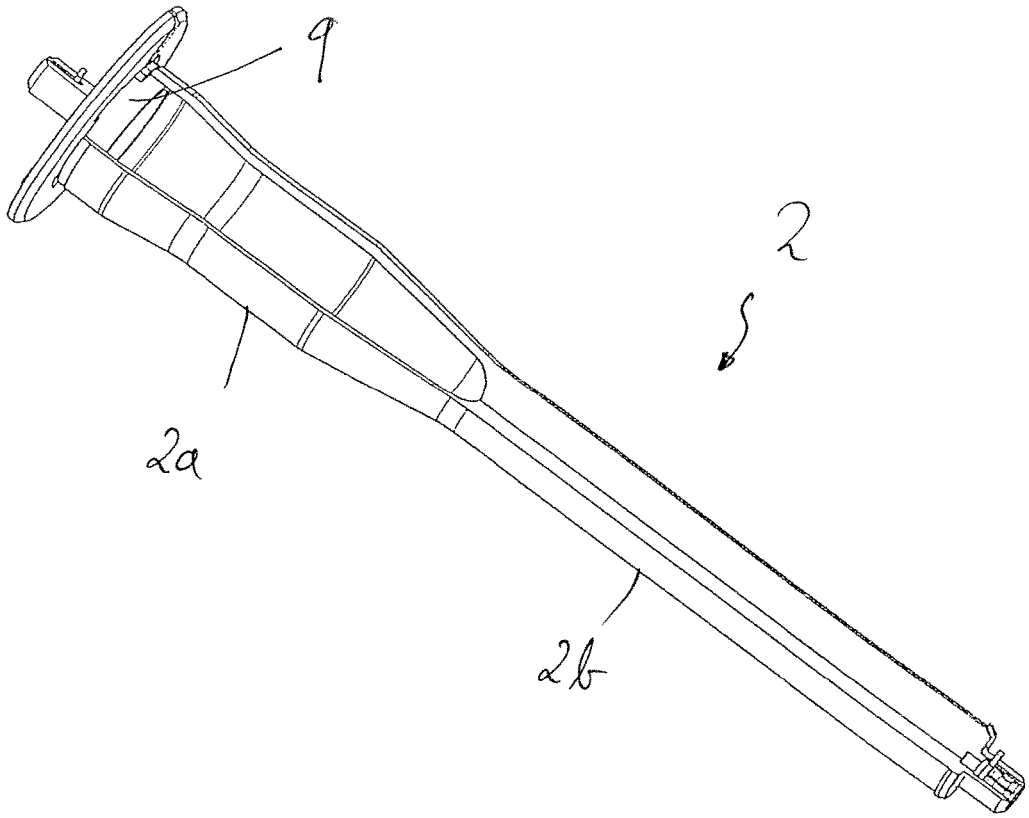
FIG. 2 shows an exemplary embodiment of the coil body of the corona ignition device.

In the embodiment shown in FIG. 2, only a thicker section 2*a* of the coil body 2 is hollow. A thinner, cylindrical section 2*b*, which is solid, adjoins the thicker section 2*a*, which is tubular or sleeve-shaped. The thicker section 2*a* tapers towards the thinner section 2*b*. The hollow, thicker section 2*a* bears only some of the turns of the coil winding 1, for example between one quarter and one half of the total turns of the coil winding 1. The thicker, hollow section 2*a* is closed with a cover 9 at its end facing away from the ignition electrode 3. The cover 9 has a cylindrical continuation, which engages in the coil body 2, and a flange, which bears against the end of the coil body 2.

Figure 3:
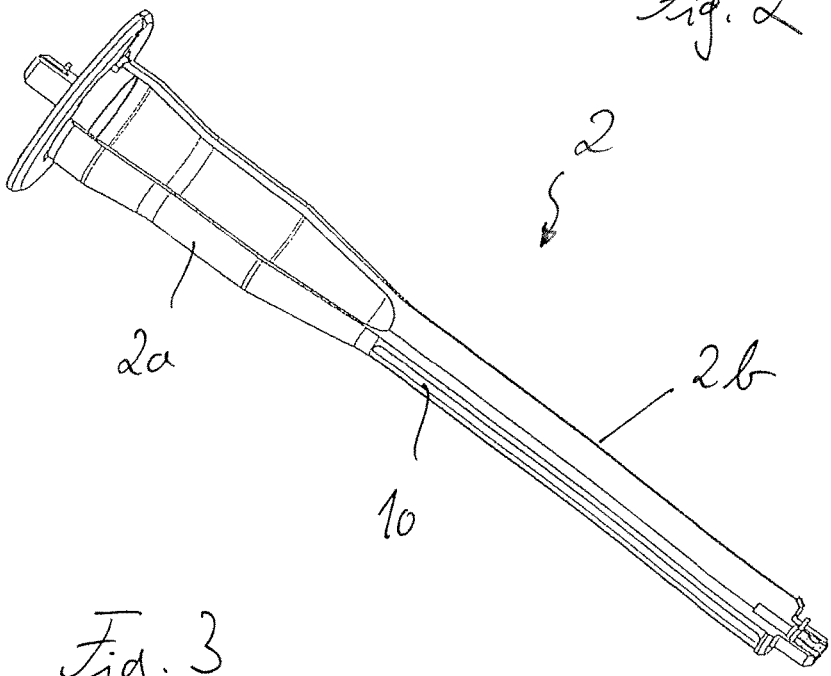
FIG. 3 shows a further exemplary embodiment of the coil body of the corona ignition device.

FIG. 3 shows a further exemplary embodiment of a coil body 2, which differs from the exemplary embodiment of FIG. 2 only in that the thinner, solid section 2*b* of the coil body 2 has on its outside one or more grooves 10 running in the longitudinal direction. At least one of said grooves 10 can be empty, that is, filled with gas. The grooves 10 thus additionally reduce the mass of the coil body 2 and, like the thicker, hollow section 2*a*, help to ensure that the resonant frequency of the coil body 2 lies outside the excitation range of common internal combustion engines. In addition, the grooves 10 make it possible to save on materials during the injection-moulding process.

Figure 4:
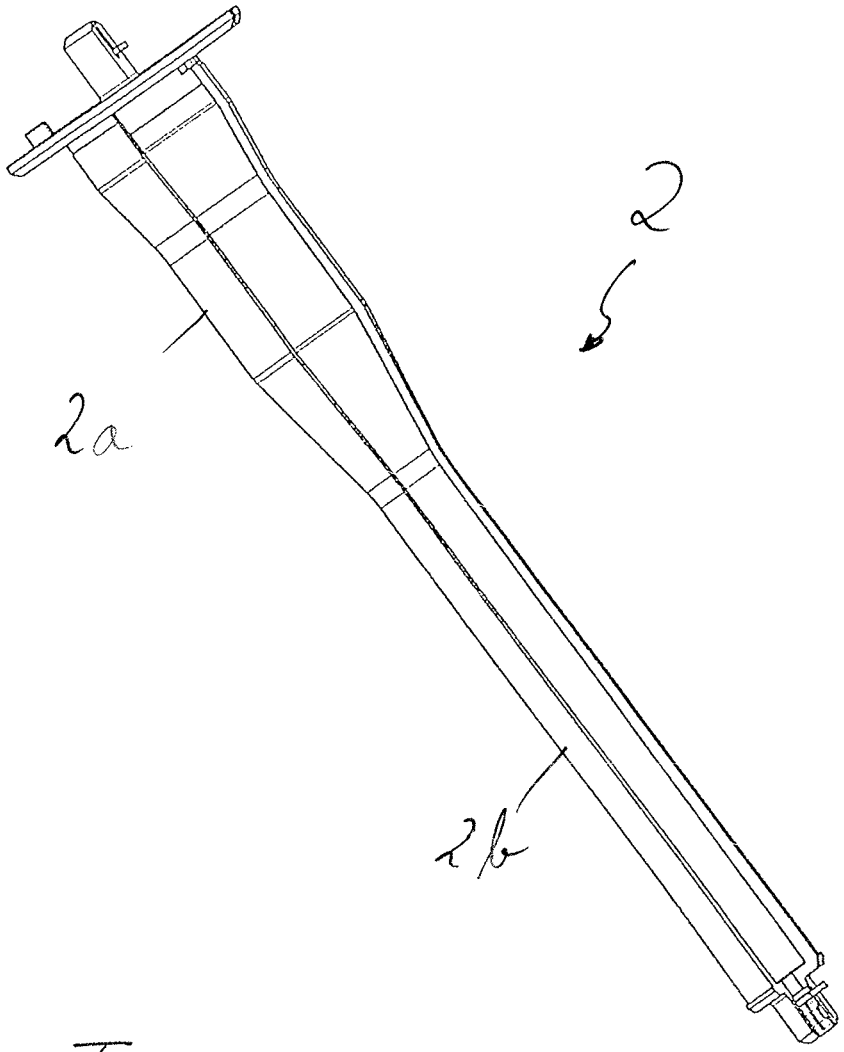
FIG. 4 shows a further exemplary embodiment of the coil body of the corona ignition device.

A further embodiment of a coil body 2 is shown in FIG. 4. In this embodiment, both the thicker section 2*a* and the thinner section 2*b* are hollow.

The coil body 2 can be composed of part-bodies. For example, the sections 2*a* and 2*b* can be produced separately and connected in a materially cohesive or form-fitting manner.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

1 Coil winding
2 Coil body
2*a* Section of the coil body
2*b* Section of the coil body
3 Ignition electrode
4 Insulator
5 Housing
6 Housing section
7 Plug
8 Cavity
9 Cover
10 Groove

What is claimed is:

1. A corona ignition device, comprising:

a coil comprising an elongate coil body and a coil winding wound onto the coil body;

an ignition electrode connected to the coil; and an insulator, inside which the ignition electrode is situated;

wherein the coil body has a hollow section.

2. The corona ignition device according to claim 1, wherein the hollow section of the coil body is formed by a tube or sleeve.

3. The corona ignition device according to claim 1, wherein the coil body includes two or more parts.

4. The corona ignition device according to claim 1, wherein the coil body is thinner at an end facing the ignition electrode than at an end facing away from the ignition electrode, so that the coil winding has a smaller diameter at the end facing the ignition electrode than at the end facing away from the ignition electrode.

5. The corona ignition device according to claim 1, wherein the coil body is closed at both ends.

6. The corona ignition device according to claim 1, wherein the coil body has at an end facing the ignition electrode a solid section, which is covered by the coil winding.

7. The corona ignition device according to claim 6, wherein the solid section has one or more grooves extending in the longitudinal direction of the coil body.

8. The corona ignition device according to claim 7, wherein the groove or the grooves are gas-filled.

9. The corona ignition device according to claim 1, wherein the coil winding is a single-layered coil winding.

10. The corona ignition device according to claim 1, wherein the coil is surrounded by a tubular housing.

* * * * *